US008002030B2

(12) United States Patent
Turley et al.

(10) Patent No.: US 8,002,030 B2
(45) **Date of Patent: *Aug. 23, 2011**

(54) RETRIEVABLE BRIDGE PLUG

(75) Inventors: Rocky A. Turley, Houston, TX (US); Joseph R. Garcia, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 168 days.

This patent is subject to a terminal disclaimer.

(21) Appl. No.: 12/144,403

(22) Filed: Jun. 23, 2008

(65) Prior Publication Data

US 2009/0000792 A1 Jan. 1, 2009

Related U.S. Application Data

(63) Continuation of application No. 11/344,289, filed on Jan. 31, 2006, now Pat. No. 7,389,823, which is a continuation of application No. 10/619,087, filed on Jul. 14, 2003, now Pat. No. 7,036,602.

(51) Int. Cl.
*E21B 23/00* (2006.01)

(52) U.S. Cl. ..... 166/134; 166/217

(58) Field of Classification Search ..... 166/382, 166/387, 118, 134, 135, 217
See application file for complete search history.

(56) References Cited

U.S. PATENT DOCUMENTS

| | | | |
|---|---|---|---|
| 1,342,780 | A | 6/1920 | Vedder |
| 1,512,621 | A | 10/1924 | Mack |
| 1,648,377 | A | 11/1927 | Crowell |
| 1,684,266 | A | 9/1928 | Fisher et al. |
| 2,043,225 | A | 6/1936 | Armentrout et al. |
| 2,084,611 | A | 6/1937 | Crickmer |
| 2,092,042 | A | 9/1937 | Armentrout et al. |
| 2,134,749 | A | 11/1938 | Burt |
| 2,155,129 | A | 4/1939 | Hall et al. |
| 2,160,804 | A | 5/1939 | Hall et al. |
| 2,171,049 | A | 8/1939 | Simmons |
| 2,204,659 | A | 6/1940 | Burt |
| 2,205,119 | A | 6/1940 | Hall et al. |
| 2,299,057 | A | 10/1942 | McClain |
| 2,319,514 | A | 5/1943 | Penfield |
| 2,331,185 | A | 10/1943 | Gordy |
| 2,331,293 | A | 10/1943 | Ballard |
| 2,479,394 | A | 8/1949 | Montgomery |
| 2,589,506 | A | 3/1952 | Morrisett |
| 2,605,846 | A | 8/1952 | Brunt et al. |
| 2,647,584 | A | 8/1953 | Baker et al. |
| 2,695,672 | A | 11/1954 | Lane |
| 2,753,940 | A | 7/1956 | Bonner |
| 2,778,430 | A | 1/1957 | Baker |
| 2,780,294 | A | 2/1957 | Loomis |
| 2,806,536 | A | 9/1957 | Baker et al. |
| 2,884,938 | A | 5/1959 | Hildebrandt |
| 2,942,665 | A | 6/1960 | Davis et al. |
| 3,002,561 | A | 10/1961 | Baker et al. |

(Continued)

FOREIGN PATENT DOCUMENTS

| | | |
|---|---|---|
| CA | 1170988 | 7/1984 |

(Continued)

*Primary Examiner* — William P Neuder
(74) *Attorney, Agent, or Firm* — Patterson & Sheridan, LLP

(57) ABSTRACT

A method and apparatus for a bridge plug for isolating portions of a downhole casing is provided comprising a retrievable upper mandrel assembly and a lower mandrel assembly coupled to the upper mandrel assembly, wherein the lower mandrel assembly comprises a drillable material.

10 Claims, 13 Drawing Sheets

U.S. PATENT DOCUMENTS

| | | | | |
|---|---|---|---|---|
| 3,055,424 | A | 9/1962 | Allen | |
| 3,062,295 | A | 11/1962 | Hanes | |
| 3,087,548 | A * | 4/1963 | Graham | 166/127 |
| 3,094,169 | A | 6/1963 | Conrad | |
| 3,136,365 | A | 6/1964 | Carter et al. | |
| 3,294,173 | A | 12/1966 | Hodges | |
| 3,298,440 | A | 1/1967 | Current | |
| 3,306,366 | A | 2/1967 | Muse | |
| 3,343,607 | A | 9/1967 | Current | |
| 3,356,140 | A | 12/1967 | Young | |
| 3,362,478 | A | 1/1968 | McReynolds, Jr. | |
| 3,371,716 | A | 3/1968 | Current | |
| 3,398,795 | A | 8/1968 | Elliston | |
| 3,497,002 | A | 2/1970 | Berryman | |
| 3,497,003 | A | 2/1970 | Berryman et al. | |
| 3,506,067 | A | 4/1970 | Lebourg | |
| 3,513,511 | A | 5/1970 | Crickmer | |
| 3,529,667 | A | 9/1970 | Malone | |
| 3,530,934 | A | 9/1970 | Kisling, III | |
| 3,643,282 | A | 2/1972 | Lechene et al. | |
| 3,687,196 | A | 8/1972 | Mullins | |
| 3,710,862 | A | 1/1973 | Young et al. | |
| 3,749,166 | A | 7/1973 | Young | |
| 3,799,260 | A | 3/1974 | Barrington | |
| 3,842,905 | A | 10/1974 | Morrisett et al. | |
| 3,910,348 | A | 10/1975 | Pitts | |
| 4,067,358 | A | 1/1978 | Streich | |
| 4,103,498 | A | 8/1978 | Steinborn et al. | |
| 4,151,875 | A | 5/1979 | Sullaway | |
| 4,153,108 | A | 5/1979 | Pounds et al. | |
| 4,175,619 | A | 11/1979 | Davis | |
| 4,182,423 | A | 1/1980 | Ziebarth et al. | |
| 4,190,111 | A | 2/1980 | Davis | |
| 4,190,112 | A | 2/1980 | Davis | |
| 4,300,631 | A | 11/1981 | Sainato et al. | |
| 4,349,205 | A | 9/1982 | McGee et al. | |
| 4,397,351 | A | 8/1983 | Harris | |
| 4,410,210 | A | 10/1983 | de Sivry et al. | |
| 4,427,063 | A | 1/1984 | Skinner | |
| 4,520,870 | A | 6/1985 | Pringle | |
| 4,545,431 | A | 10/1985 | Fore | |
| 4,595,052 | A | 6/1986 | Kristiansen | |
| 4,611,658 | A | 9/1986 | Salerni et al. | |
| 4,665,978 | A | 5/1987 | Luke | |
| 4,669,540 | A | 6/1987 | Luoma et al. | |
| 4,688,641 | A | 8/1987 | Knieriemen | |
| 4,700,954 | A | 10/1987 | Fischer | |
| 4,708,202 | A | 11/1987 | Sukup et al. | |
| 4,711,300 | A | 12/1987 | Wardlaw, III et al. | |
| 4,720,113 | A | 1/1988 | Hertz, Jr. | |
| 4,730,835 | A | 3/1988 | Wilcox et al. | |
| 4,753,444 | A | 6/1988 | Jackson et al. | |
| 4,784,226 | A | 11/1988 | Wyatt | |
| 4,834,176 | A | 5/1989 | Renfroe, Jr. | |
| 4,834,184 | A | 5/1989 | Streich et al. | |
| 4,836,279 | A | 6/1989 | Freeman | |
| 4,858,687 | A | 8/1989 | Watson et al. | |
| 4,915,175 | A | 4/1990 | Mashaw, Jr. | |
| 4,928,760 | A | 5/1990 | Freitas | |
| 4,942,923 | A | 7/1990 | Geeting | |
| 4,977,958 | A | 12/1990 | Miller | |
| 5,048,613 | A * | 9/1991 | Shilling | 166/387 |
| 5,078,211 | A | 1/1992 | Swineford | |
| 5,095,980 | A | 3/1992 | Watson | |
| 5,146,994 | A | 9/1992 | Pleasants et al. | |
| 5,224,540 | A | 7/1993 | Streich et al. | |
| 5,226,492 | A | 7/1993 | Solaeche P. et al. | |
| 5,271,468 | A | 12/1993 | Streich et al. | |
| 5,333,685 | A | 8/1994 | Gilbert | |
| 5,390,737 | A | 2/1995 | Jacobi et al. | |
| 5,540,279 | A | 7/1996 | Branch et al. | |
| 5,701,959 | A | 12/1997 | Hushbeck et al. | |
| 5,839,515 | A | 11/1998 | Yuan et al. | |
| 5,857,520 | A | 1/1999 | Mullen et al. | |
| 5,884,699 | A | 3/1999 | Mullen et al. | |
| 5,890,537 | A | 4/1999 | Lavaure et al. | |
| 5,984,007 | A | 11/1999 | Yuan et al. | |
| 6,167,963 | B1 | 1/2001 | McMahan et al. | |
| 6,220,349 | B1 | 4/2001 | Vargus et al. | |
| 6,491,108 | B1 * | 12/2002 | Slup et al. | 166/387 |
| 6,578,633 | B2 | 6/2003 | Slup et al. | |
| 6,708,770 | B2 | 3/2004 | Slup et al. | |
| 6,712,153 | B2 | 3/2004 | Turley et al. | |
| 7,017,672 | B2 | 3/2006 | Owen, Sr. | |
| 7,036,602 | B2 | 5/2006 | Turley et al. | |
| 7,124,831 | B2 | 10/2006 | Turley et al. | |
| 7,419,009 | B2 | 9/2008 | Cook et al. | |
| 2004/0177952 | A1 | 9/2004 | Turley et al. | |
| 2004/0216868 | A1 * | 11/2004 | Owen, Sr. | 166/134 |

FOREIGN PATENT DOCUMENTS

| | | |
|---|---|---|
| CA | 2041270 | 10/1991 |
| CA | 2 071 721 | 4/2003 |
| DE | 1921014 | 10/1970 |
| DE | 2733199 | 2/1979 |
| DE | 3325931 | 7/1984 |
| DE | 8707207.6 | 11/1987 |
| DE | 8707208.4 | 11/1987 |
| DE | 3621354 | 1/1988 |
| DE | 3700717 | 7/1988 |
| DE | 3704969 | 8/1988 |
| DE | 3625393 | 2/1992 |
| EP | 0 454 466 | 10/1991 |
| EP | 0 519 757 | 12/1992 |
| EP | 0 570 157 | 11/1993 |
| EP | 1 052 369 | 11/2000 |
| GB | 749731 | 5/1956 |
| SU | 479868 | 8/1975 |
| SU | 543730 | 3/1977 |
| SU | 543732 | 3/1977 |
| SU | 717273 | 2/1980 |
| SU | 1399449 | 5/1988 |
| SU | 1416664 | 8/1988 |
| WO | WO 92/20899 | 11/1992 |

* cited by examiner

RETRIEVABLE BRIDGE PLUG

CROSS-REFERENCE TO RELATED APPLICATIONS

This application is a continuation of U.S. patent application Ser. No. 11/344,289, filed Jan. 31, 2006 now U.S. Pat. No. 7,389,823, which is a continuation of co-pending U.S. patent application Ser. No. 10/619,087, filed Jul. 14, 2003, now U.S. Pat. No. 7,036,602. Each of the aforementioned related patent applications is herein incorporated by reference in its entirety.

BACKGROUND OF THE INVENTION

Field of the Invention

In the completion of oil and gas wells, there are various downhole operations in which it may become necessary to isolate particular zones within the well. This is typically accomplished by temporarily plugging off the well casing at a given point or points with a bridge plug. Bridge plugs are particularly useful in accomplishing operations such as isolating perforations in one portion of a well from perforations in another portion, or for isolating the bottom of a well from a wellhead. The purpose of the plug is simply to isolate some portion of the well from another portion of the well. However, in some instances, the bridge plug may not necessarily be used for isolation, but may be used, for example, to create a cement plug in the wellbore. The bridge plug may be temporary or permanent; if temporary, it must be removable.

Bridge plugs may be drillable or retrievable. Drillable bridge plugs are typically constructed of a brittle metal such as cast iron that can be drilled out. One typical problem with conventional drillable bridge plugs, however, is that without some sort of locking mechanism, the bridge plug components may tend to rotate with the drill bit, which can result in extremely long drill-out times, excessive casing wear, or both. Long drill-out times are highly undesirable, as rig time is typically charged by the hour.

An alternative to drillable bridge plugs is the retrievable bridge plug, which may be used to temporarily isolate portions of the well before being removed, intact, from the well interior. Retrievable bridge plugs typically have anchor and sealing elements that engage and secure it to the casing wall. To retrieve the plug, a retrieving tool is lowered into the casing to engage a retrieving latch, which, through a retrieving mechanism, retracts the anchor and sealing elements, allowing the bridge plug to be pulled out of the wellbore. A common problem with retrievable bridge plugs is the accumulation of debris on the top of the plug, which may make it difficult or impossible to engage the retrieving latch to remove the plug. Such debris accumulation may also adversely affect the relative movement of various parts within the bridge plug. Furthermore, with current retrieving tools, jarring motions or friction against the well casing can cause accidental unlatching of the retrieving tool, or re-locking of the bridge plug (due to activation of the plug anchor elements). It may also be difficult to separate the retrieving tool from the plug upon removal, necessitating the use of additional machinery. Problems such as these sometimes make it necessary to drill out a bridge plug that was intended to be retrievable.

Thus, there is a need in the art for a bridge plug whose performance is not impaired by undesirable conditions such as differential pressure zones or wellbore debris, and that may be removed from the wellbore without undue exertion or cost.

SUMMARY OF THE INVENTION

One embodiment of the present invention provides a bridge plug for isolating portions of a downhole casing comprising a retrievable upper mandrel assembly and a lower mandrel assembly coupled to the upper mandrel assembly, wherein the lower mandrel assembly comprises a drillable material.

BRIEF DESCRIPTION OF THE DRAWINGS

So that the manner in which the above recited embodiments of the invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

The present invention aims to provide an improved bridge plug that is both retrievable and drillable. Existing bridge plugs that are either retrievable or drillable individually suffer from respective shortcomings related to plug setting and removal. The present invention provides a retrievable bridge plug having several drillable components, preferably made of composite materials, and therefore it may be retrieved, drilled, or both for removal as need dictates.

Figure 1A:
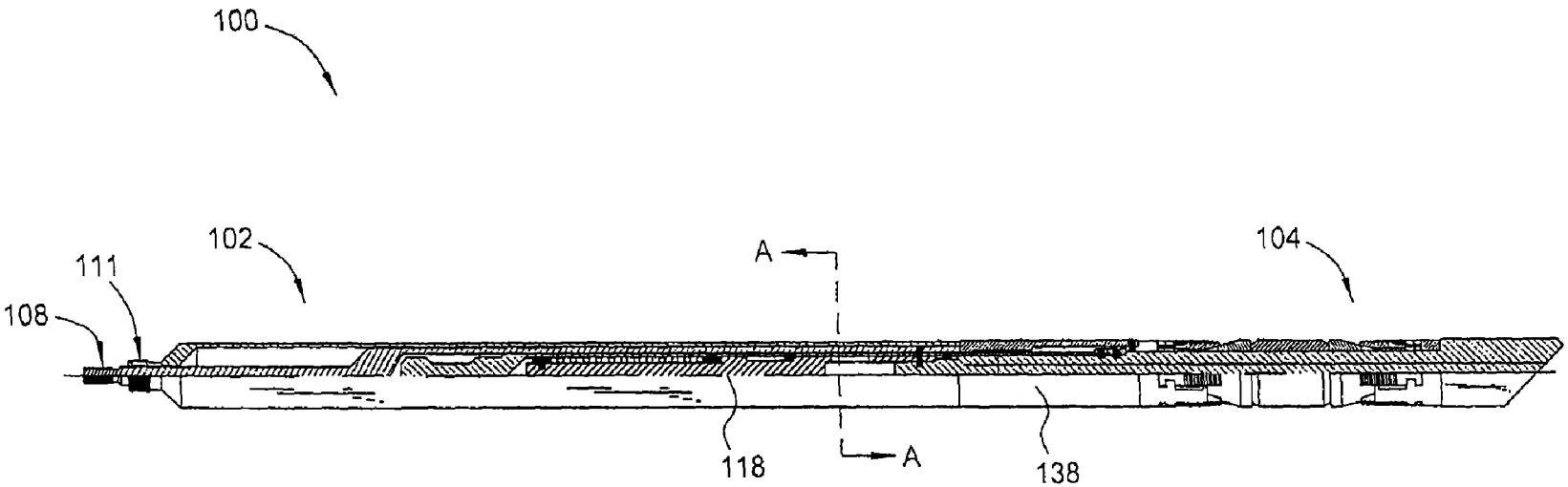
FIG. 1A is a longitudinal cross-sectional view of one embodiment of a bridge plug according to the present invention.

FIG. 1A is a cross-sectional view of one embodiment of a bridge plug according to the present invention. While FIG. 1A illustrates the tool in its entirety, FIGS. 1B and 1C each depict roughly one half of the tool (cut along line A-A in FIG. 1A) so that the details of the present invention may be more clearly illustrated. The bridge plug 100 illustrated in FIG. 1A is in a "locked", or inactivated position, as for running into a string of casing. In one embodiment, the bridge plug 100 comprises an upper mandrel assembly 102 and a lower mandrel assembly 104.

Figure 1B:
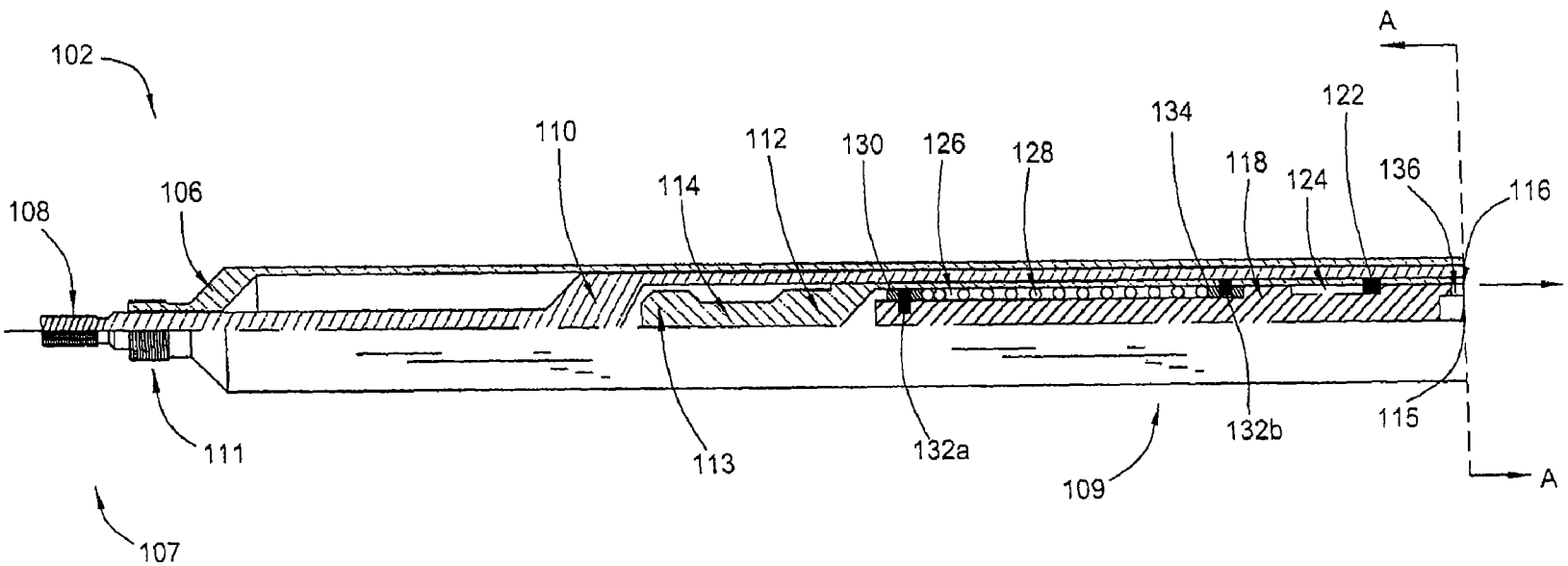
FIG. 1B is a longitudinal cross-sectional view of the upper mandrel assembly of FIG. 1A.

The upper mandrel assembly 102 is illustrated in further detail in FIG. 1B and comprises a substantially tubular outer setting sleeve 106 having a connection 108 at an upper end 107 of the assembly 102. The connection 108 is threaded for attachment to a hydraulic or explosive operated tool (not shown). The setting sleeve 106 houses a setting tool body 110, which has a threaded sucker rod connection 111 at its upper end, and in turn carries a selection tool 112 having a fishing neck 114 at an upper end 113 and a radial port 116 proximate a lower end 115 of the upper mandrel assembly 102. Within the selection tool 112 is an upper mandrel 118, and the setting tool body 110, selection tool 112, and upper mandrel 118 are secured to one another by an upper shear pin 120 located proximate lower end 115 of the upper mandrel assembly 102, distal from the sucker rod connection 111. Furthermore, a selection tool lug 122 extends radially inward from the selection tool 112 toward the upper mandrel 118, to engage an annular, sinuous groove 124 that extends around the outer circumference of the mandrel 118.

A portion of the upper mandrel 118 that is distal from the shear pin 120 connection is surrounded by a spring housing 126. The spring housing 126 houses a coil spring 128 that is carried around the upper mandrel 118. An upper spring stop 130 is secured, for example by a pin 132*a*, to the mandrel 118, while a lower spring stop 134 is secured to the selection tool 112, also by a pin 132*b*. The coil spring 128 is restrained axially within the upper and lower spring stops 130, 134. Below the spring housing 126, but above the upper shear pin 120, a radial port 136 is provided in the upper mandrel 118.

Figure 1C:
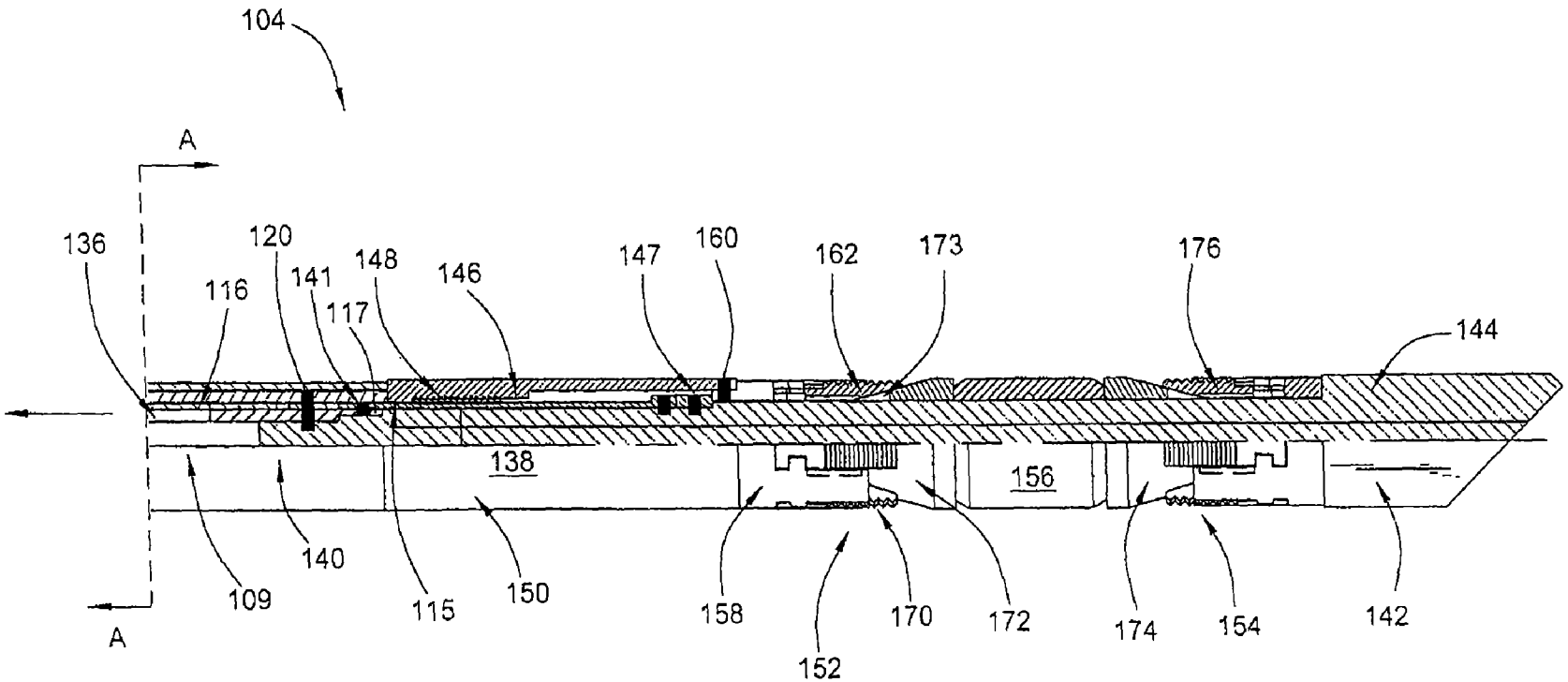
FIG. 1C is a longitudinal cross-sectional view of the lower mandrel assembly of FIG. 1A.

The lower mandrel assembly 104 is illustrated in further detail in FIG. 1C and is coupled to the lower end 115 of the upper mandrel assembly 102. The lower mandrel assembly 104 comprises a lower mandrel 138 preferably comprised of a composite material and having a first end 140 that fits within the lower end 115 of the upper mandrel 118. Composite materials are well known in the art and typically comprise high-strength plastics containing fillers such as carbon or glass fiber. The lower mandrel 138 is secured in place by the upper shear pins 120 and 141 that secure the upper mandrel 118, selection tool 112, and setting tool body 110. A second end 142 of the lower mandrel 138 terminates in a nose shoe 144. The nose shoe 144 forms the lowermost portion of the bridge plug 100.

A body lock ring housing 146 surrounds the lower mandrel 138 just below the setting tool body 110 and upper mandrel 118. The body lock ring housing 146 may be formed of metallic or composite material and carries a lock ring 148. The lock ring 148 comprises a plurality of teeth 150 that engage the lower end 115 of the selection tool 112 and secure the selection tool 112 to the lower mandrel 138.

The lower mandrel assembly 104 further comprises upper and lower slip and cone assemblies 152, 154 and a resilient packer element 156. The upper slip and cone assembly 152 comprises a slip cage 158 formed of a composite material and secured by a lower shear pin 160 to a lower end 147 of the lock ring housing 146. The upper slip cage 158 carries a plurality of upper slip segments 162, each of which comprises a plurality of teeth 170 and surrounds a tapered end 173 of a conical upper cone 172, also formed of a composite material. Thus, the upper cone 172 is situated to slide upwardly beneath the upper slip segments 162. A lower slip and cone assembly 154 is formed similarly but is oriented to oppose the upper slip and cone assembly 152; that is, the lower slip segments 176 slide upwardly beneath the lower cone 174. The upper and lower slip and cone assemblies 152, 154 are spaced longitudinally so that a resilient packer element 156 may be retained between the upper and lower cones 172, 174.

Figure 2A:
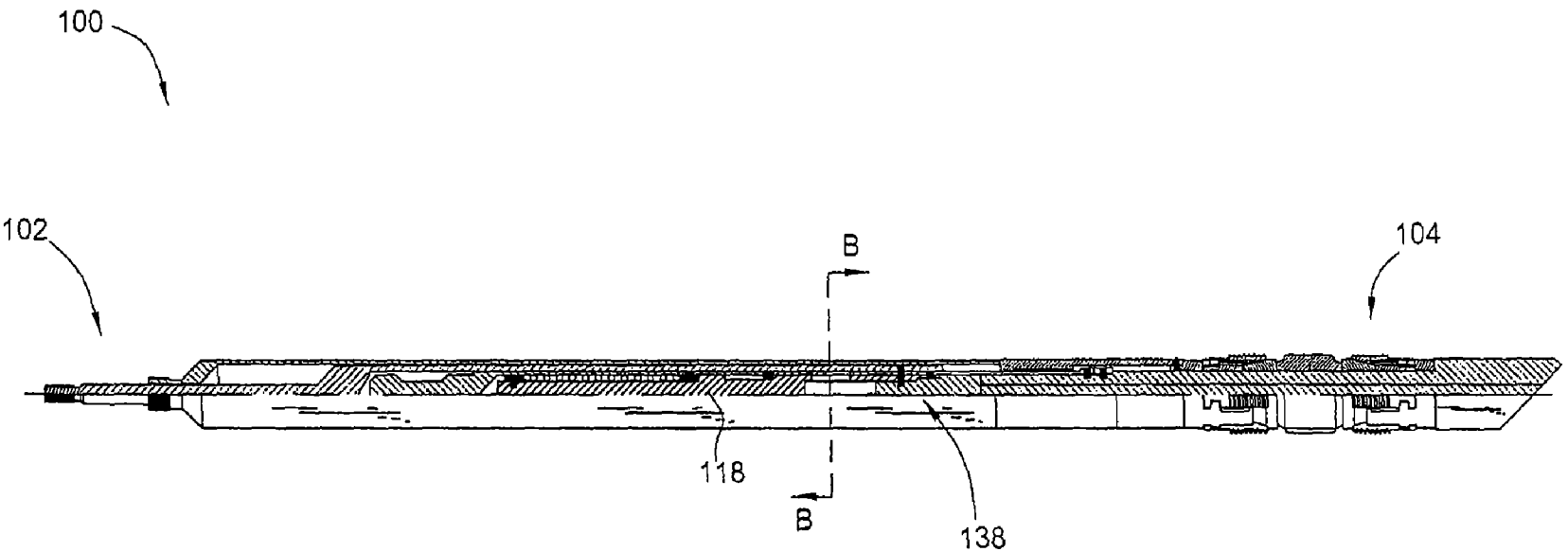
FIG. 2A is a longitudinal cross-sectional view of the bridge plug of FIG. 1A in the set position.
Figure 2B:
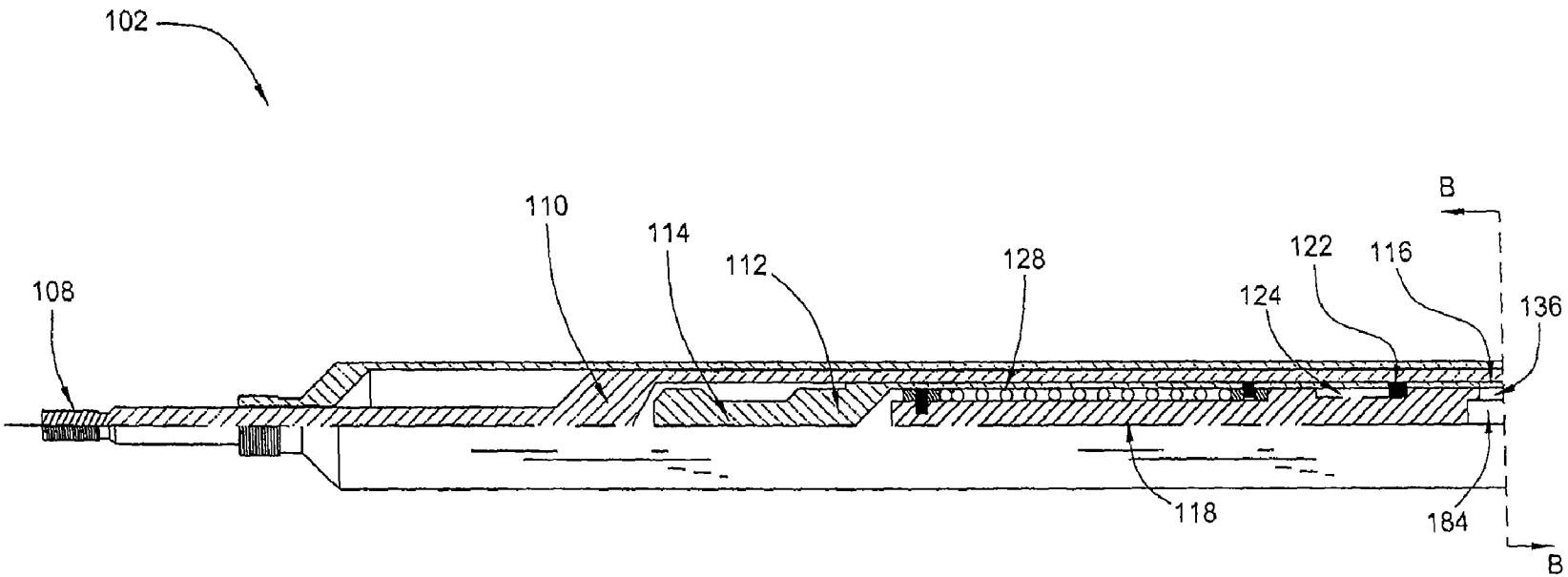
FIG. 2B is a longitudinal cross-sectional view of the upper mandrel assembly of FIG. 2A.
Figure 2C:
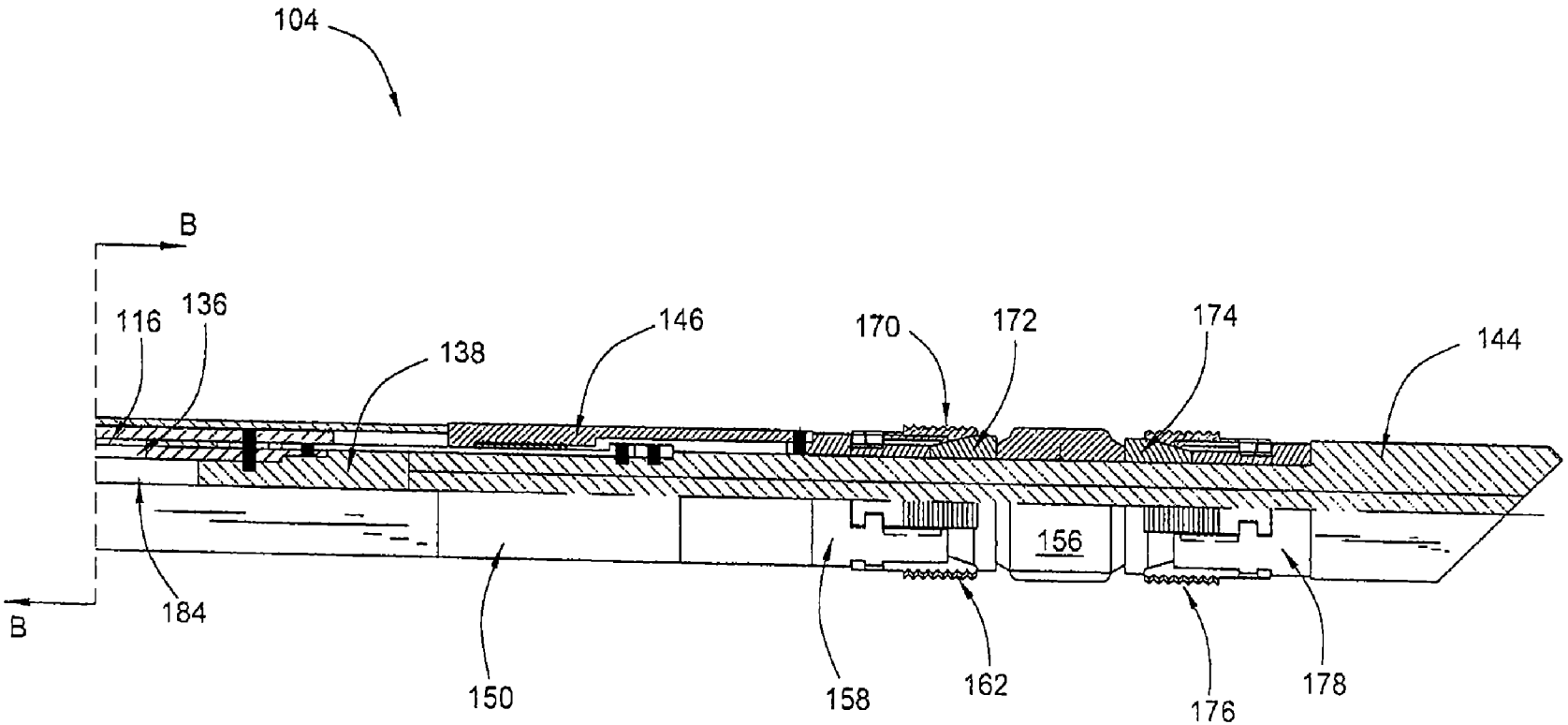
FIG. 2C is a longitudinal cross-sectional view of the lower mandrel assembly of FIG. 2A.

The operation of the bridge plug embodiment illustrated in FIG. 1A may best be understood with reference to FIGS. 2A-C, which illustrates the bridge plug of FIG. 1A in the "set" position. FIG. 2A illustrates the bridge plug 100 in its entirety, while FIGS. 2B and 2C each illustrate roughly one half (or the upper and lower mandrel assemblies 102, 104, respectively) of the bridge plug 100 shown in FIG. 2A.

The hydraulic or explosive operated tool (not shown) that is coupled to the sucker rod connection 108 on the upper mandrel assembly 102 is actuated to exert a downward force on the setting tool 110, while pulling up on the main body of the bridge plug 100, including the slips 162, 176 and packer element 156. This provides an upward force against the nose shoe 144 that moves the cones 172, 174 into the slips 158, 178. As the cones 172, 174 move into the slip cages 158, 178, they also are forced closer together, compressing the packer element 156 longitudinally so that it expands or extends radially outward. The travel of the cones 172, 174 beneath the slip cages 158, 178 also expands the slip segments 162, 176 radially outward so that the teeth 170 "bite" into and engage the inner wall 182 of the casing 180, which secures the packer element 156 in its compressed and fully expanded condition. At the same time, the body lock ring housing 146 is forced downwardly with relation to the bridge plug body 100, the lock ring teeth 150 bite into the body lock ring housing 146 to prevent upward movement that might release the applied downward force.

In order to allow flow through the tool 100, a central conduit 184 is provided through the slips 162, 176 and packer 156 and part of the upper mandrel 118. The radial port 136 in the upper mandrel 118 may be opened or closed depending on the relative axial positions of the upper and lower mandrels 118, 138. To open the port 136, first, upward force is applied to the setting sleeve 106 and the setting tool body 110 to break the shear pin 120, thereby allowing removal of the setting sleeve 106 and setting tool body 110. The fishing neck 114 is thus exposed for grasping by a fishing tool (not shown), supported by a wire line (not shown). Pulling upward on the fishing neck 114 exerts an upward force on the upper mandrel 118, compressing the spring 128. The selection tool lug 122 that extends radially inward from the selection tool body 112 engages the sinuous groove 124 that extends around the outer circumference of the upper mandrel 118. Thus, when the upper mandrel 118 is pulled upward, the engagement of the lug 122 with the sinuous groove 124 causes relative rotation of the upper mandrel 118 and the selection tool 112. At the same time, the spring 128 surrounding the upper mandrel 118 is compressed.

When the upward force is released, the spring 128 is relaxed, causing relative axial movement between the upper mandrel 118 and the selection tool 112. Lug movement through the grooves 124 causes simultaneous relative rotation of these components, which moves the ports 116, 136 so that they are aligned, thereby opening the port to allow fluid to flow through the tool.

To retrieve the bridge plug 100 from the wellbore, a wire line (not shown) is connected to the fishing neck 114 on the selection tool 112, and upward force is applied. This exerts an upward force that pulls on the lower mandrel 138, which in turn pulls on the body lock ring housing 146, which is connected to the upper slip cage 158. The upper slip cage 158 is thereby pulled upwardly to release the radial force on the slips 162, 176, allowing the upper cone 172 to move upwardly and release the compressive force on the packer element 156. Similarly, the lower cone 174 is removed from beneath the lower slip cage 178 so that the packer element 156 relaxes. With no radial forces forcing components of the bridge plug 100 into engagement with the inner wall 182 of the casing 180, the bridge plug 100 may be retrieved from the wellbore by pulling upwardly.

In the event that the slips 162, 176 and packer element 156 cannot be released as described above, they may be drilled out. If the application of a predetermined amount of force is not sufficient to release the slips 162, 176, an emergency release is provided to disconnect the lower mandrel assembly 104 from the remainder of the bridge plug tool 100. This release comprises the lower shear pin 160, which breaks when a sufficient amount of force is applied. The upper mandrel 118 and upper mandrel assembly 102 may be retrieved as described above. The remaining tool components—the lower mandrel 138, slips 162, 176, cones 172, 174 and packer element 156—all comprise composite material, and so a milling machine may be lowered into the well to drill out the remaining material. Thus at worst, the bridge plug tool 100 is largely retrievable, cutting down on drilling time and cost. That which might not be retrieved is made of drillable material and represents a small percentage of the overall tool material to keep the complexity and cost of removal to a minimum as well.

Figure 3A:
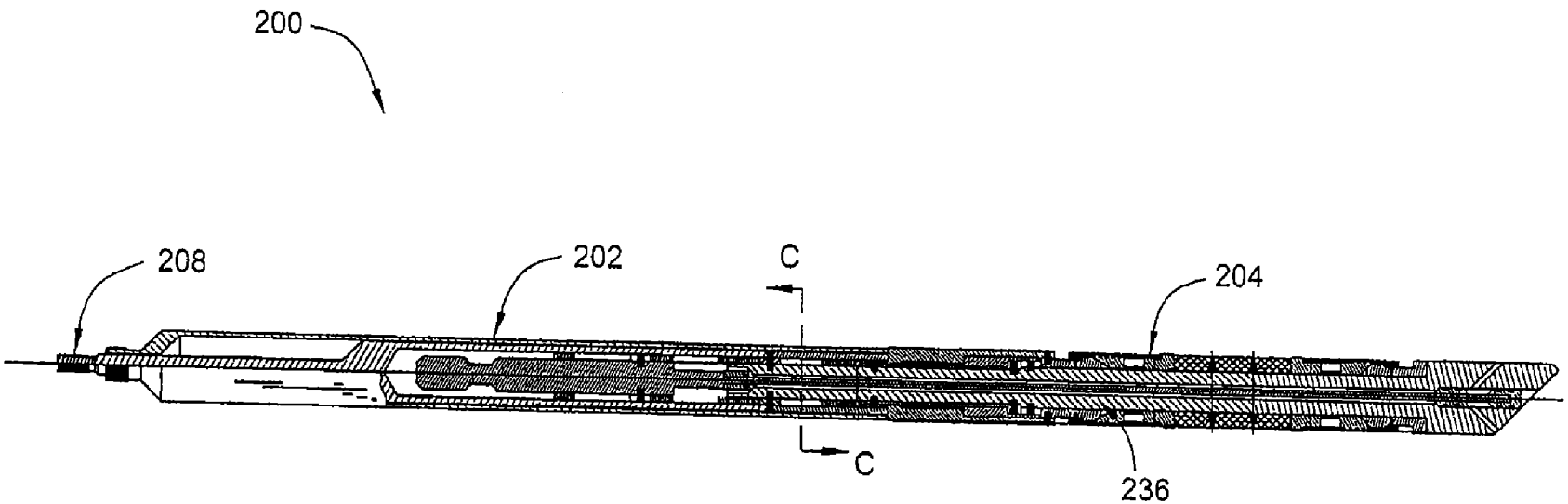
FIG. 3A is a longitudinal cross-sectional view of a second embodiment of a bridge plug according to the present invention.
Figure 3B:
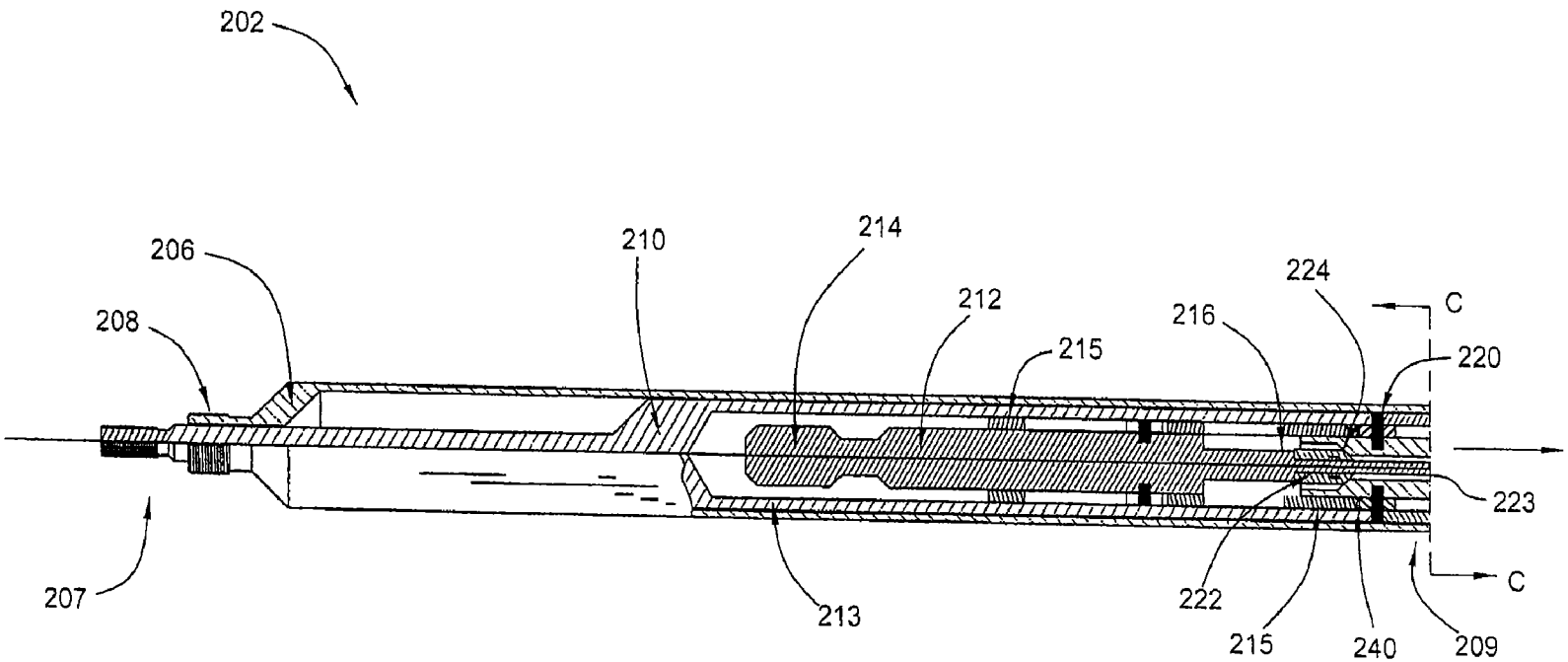
FIG. 3B is a longitudinal cross-sectional view of the upper mandrel assembly of FIG. 3A.
Figure 3C:
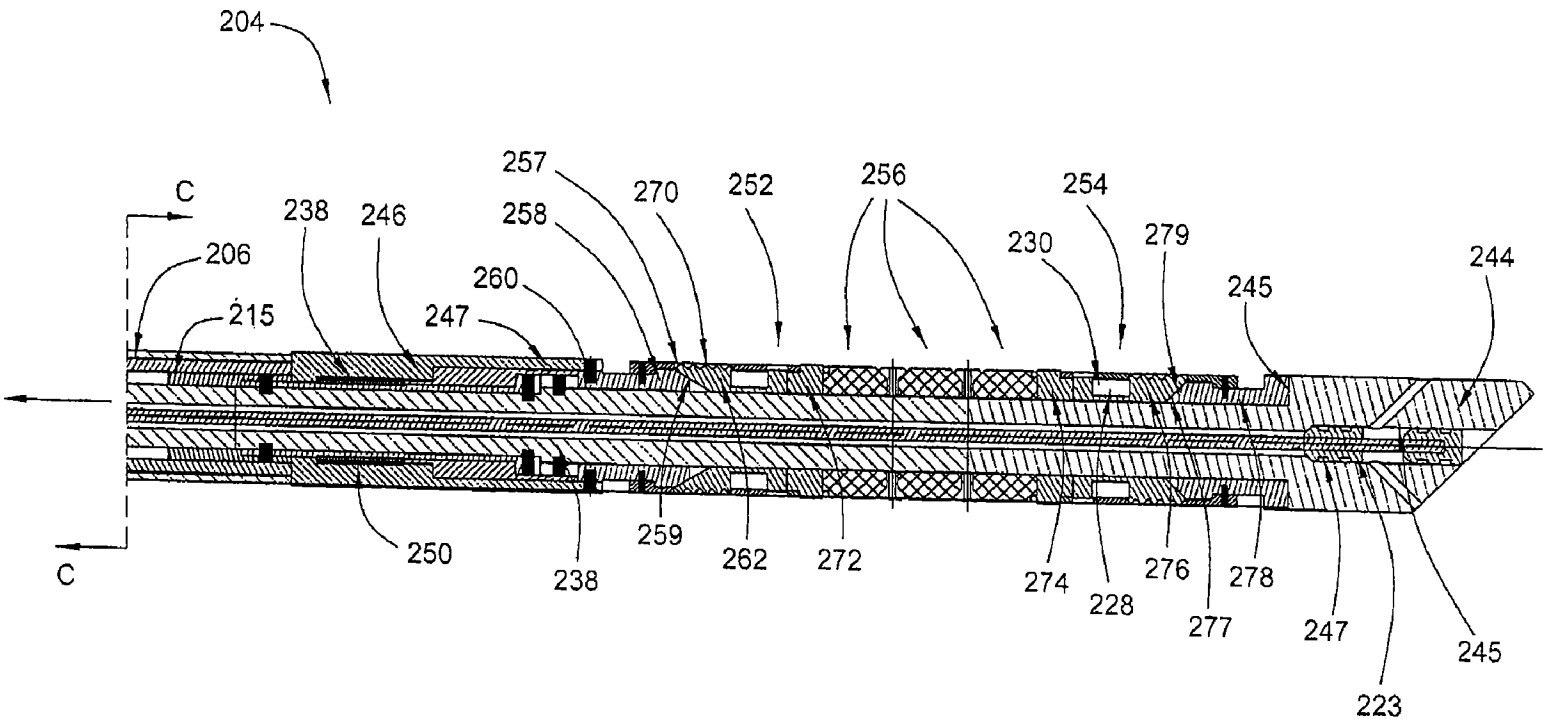
FIG. 3C is a longitudinal cross-sectional view of the lower mandrel assembly of FIG. 3A.

An alternate embodiment of the present invention in illustrated in FIGS. 3A-C. FIG. 3A is a cross-sectional view of a second embodiment of a bridge plug according to the present invention. While FIG. 3A illustrates the tool in its entirety, FIGS. 3B and 3C each depict roughly one half of the tool (cut along line C-C in FIG. 3A) so that the details of the present invention may be more clearly illustrated. The bridge plug 200 illustrated in FIG. 3A is in a "locked", or inactivated position, as for running into a string of casing. In one embodiment, the bridge plug 200 comprises an upper mandrel assembly 202 and a lower mandrel assembly 204.

The upper mandrel assembly 202 is illustrated in further detail in FIG. 3B and comprises a substantially tubular setting sleeve 206 having a threaded connection 208 at its upper end 207. The setting sleeve 206 houses a setting tool body 210, which in turn carries a selection tool 212. The selection tool 212 has an upper end 213 terminating in a fishing neck 214 and a lower end 215 terminating in a downward facing plunger 222. In addition, a radial port 216 is formed in the selection tool 212 proximate the lower end 215.

The lower mandrel assembly 204 is coupled to the lower end 209 of the upper mandrel assembly 202. The lower mandrel assembly 204 comprises a lower mandrel 238 comprised of a composite material and having an upper end 240 terminating in a counterbore 224 (shown in FIG. 3B) defined therein. The upper end 240 of the lower mandrel 238 is secured to a setting sleeve 215 and setting tool 210 by an upper shear pin 220. A lower end 242 of the lower mandrel 238 terminates in a nose shoe 244. The nose shoe 244 forms the lowermost portion of the bridge plug 200. The nose shoe 244 has a central bore 245 terminating in a conical seat 247 which receives a lower plunger 223 mounted on a rod which extends downward from the plunger 222.

A body lock ring housing 246 surrounds the lower mandrel 238 just below the upper mandrel assembly 202. The body lock ring housing 246 may be formed of a metallic or composite material and carries a lock ring 248. The lock ring 248 comprises a plurality of teeth 250 that engage the lower end 215 of the setting tool 210 and secure it to the upper end 240 of the lower mandrel 238.

The lower mandrel assembly 204 further comprises upper and lower slip and cone assemblies 252, 254 and at least one of resilient packer element 256. The upper slip and cone assembly 252 includes an upper cone 258 comprising an inclined slip ramp and secured by a lower shear pin 260 to a lower end 247 of the lock ring housing 246. The tapered end 257 of the upper cone 258 engages the tapered surface 259 of upper slip segments 262, which comprise a plurality of teeth 270. A recess 228 in the slip 262 is slidably engaged with an elongated end 230 of an upper compression element 272. Thus, the upper cone 258 is designed to slide downwardly under the slip elements 262, to force the slip elements 262 downward against the upper compression element 272 and radially outward against the inner wall 282 of the casing 280. The slip segments 262 and cone 272 are preferably formed of a composite material. A lower slip and cone assembly 254 is formed similarly but is oriented to oppose the upper slip and cone assembly 252; that is, the lower cone 278 abuts the upper end 245 of the nose shoe 244, and the slip segments 276 move downwardly so that their tapered bore 277 engages the tapered upper end 279 of the compression element 272. The upper and lower slip and cone assemblies 252, 254 are spaced longitudinally so that at least one resilient packer element 256 may be retained between the upper and lower compression elements 272, 274. In the embodiment illustrated in FIG. 3C, 3 such packer elements 256 are utilized; however, a greater or lesser number may be used.

Figure 4A:
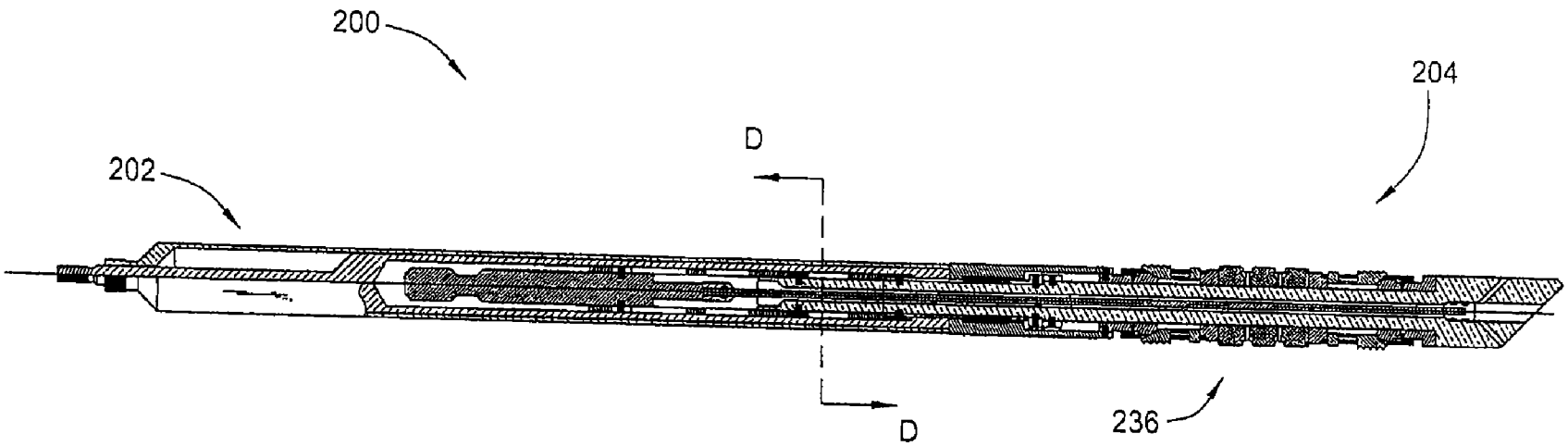
FIG. 4A is a longitudinal cross-sectional view of the bridge plug of FIG. 3A in the set position.
Figure 4B:
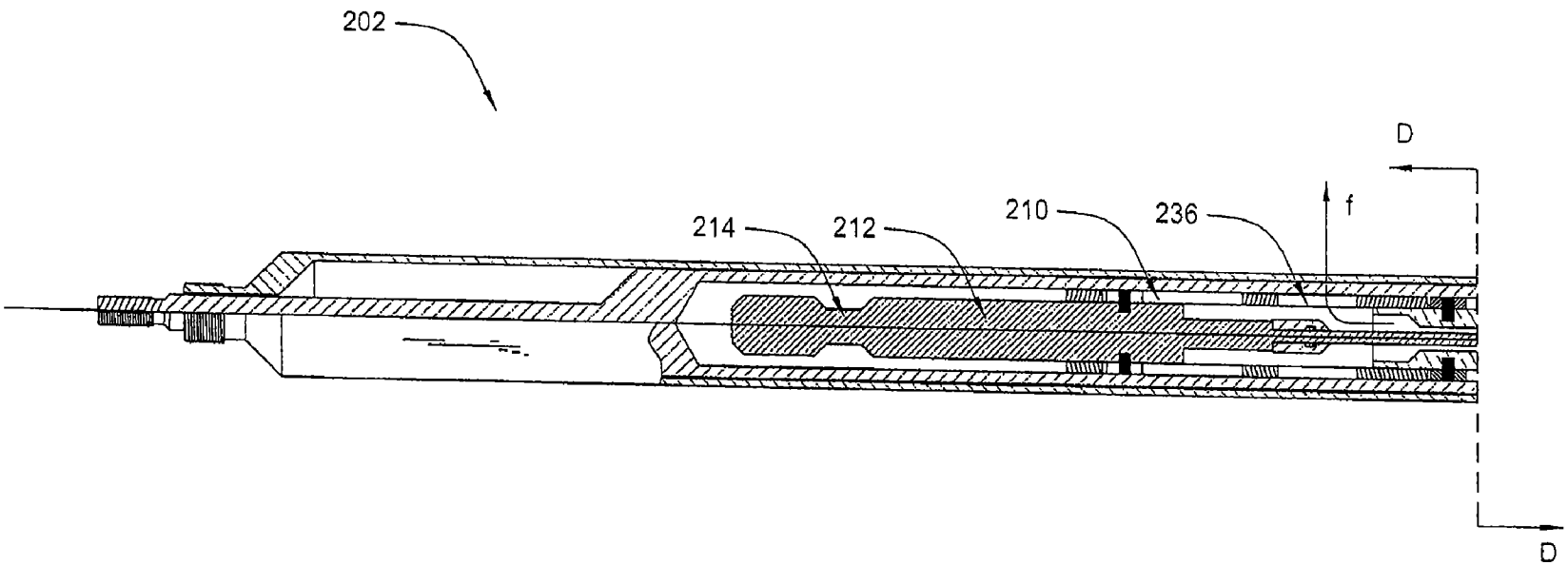
FIG. 4B is a longitudinal cross-sectional view of the upper mandrel assembly of FIG. 4A.
Figure 4C:
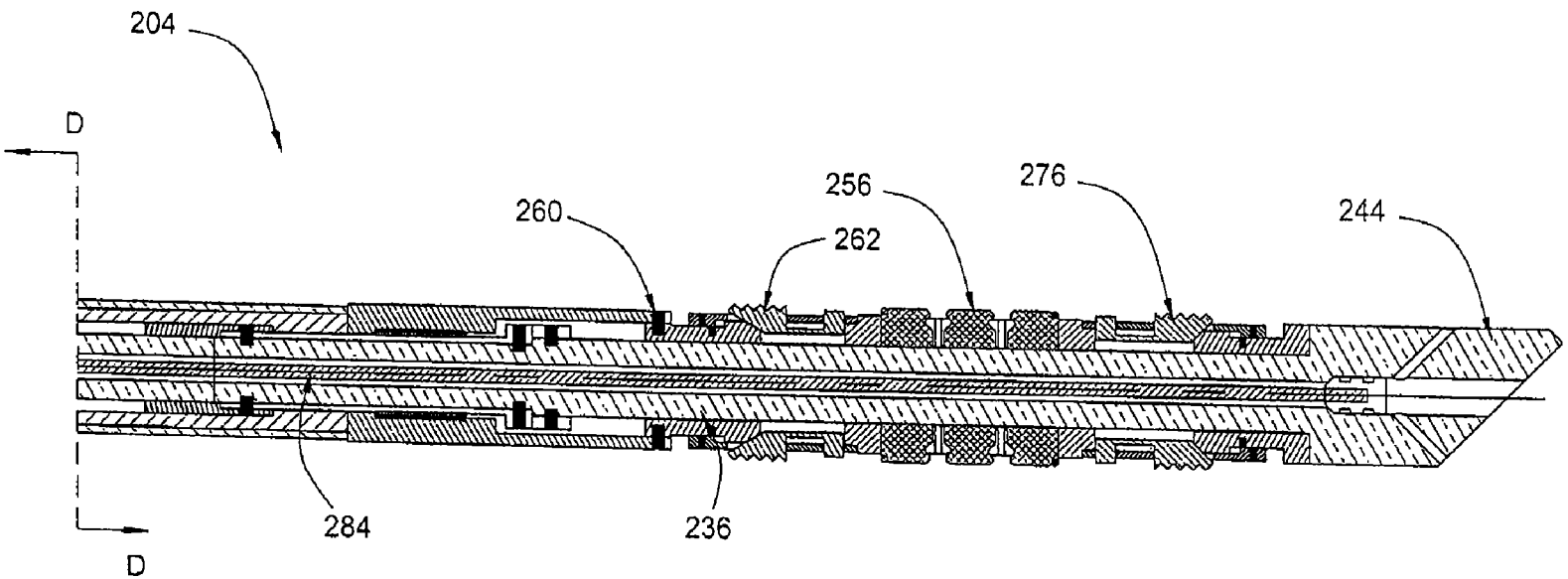
FIG. 4C is a longitudinal cross-sectional view of the lower mandrel assembly of FIG. 4A.
Figure 5:
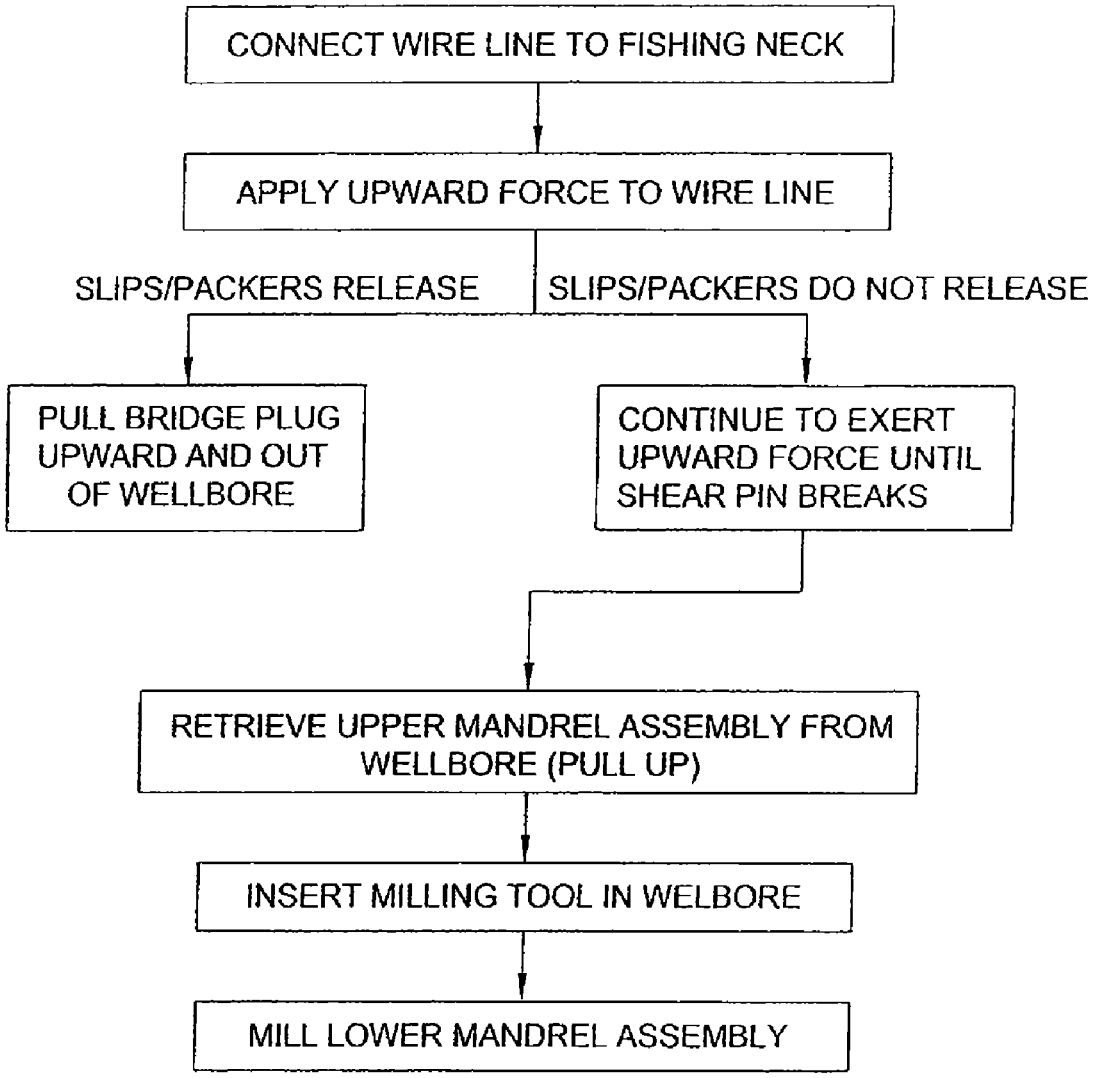
FIG. 5 is a flow diagram illustrating a method of retrieving the bridge plug of the present invention from a wellbore.

The operation of the bridge plug 200 is not unlike the operation of the bridge plug 100 discussed herein, and may best be understood with reference to FIGS. 4A-C, which illustrate the bridge plug of FIG. 3A in a "set" position. FIG. 4A illustrates the bridge plug 200 in its entirety, while FIGS. 4B and 4C each illustrate roughly one half (or the upper and lower mandrel assemblies 202, 204, respectively) of the bridge plug 200 shown in FIG. 4A.

A hydraulic or explosive tool (not shown) is coupled to the threaded connection 208 on the upper mandrel assembly 202 and is actuated to exert a downward force on the setting tool 210, while pulling up on the main body of the bridge plug 200, including the slips 262, 276 and packer elements 256. This provides an upward force against the nose shoe 244 that moves the cones 258, 278 further under the slips 262, 276 and forces the slips 262, 276 closer axially to the compression elements 272, 274. As the slips 262, 276 move closer to the compression elements 272, 274, they force the compression elements 272, 274 closer to each other, which compresses the packer elements 256 longitudinally so that they expand radially outward. The travel of the cones 258, 278 beneath the slip segments 262, 276 also expands the slip segments 262, 276 radially outward so that the teeth 270 "bite" into and engage the inner wall 282 of the casing 280, which secures the packer elements 256 in their compressed conditions. At the same time, the body lock ring housing 246 is forced downward with relation to the bridge plug body 200, and the lock ring teeth 250 bite into the body lock ring housing 246 to prevent upward movement that might release the applied downward force.

In order to allow flow through the tool 200, a central conduit 284 is provided through the slips 262, 276 and packer elements 256 and part of the upper mandrel assembly 202 (see FIGS. 4A-C, which show the bridge plug in the "set" condition). The radial port 236 in the selection tool 212 may be opened or closed depending on the relative axial position of the upper and lower mandrel assemblies 202, 204. To open the port 236, first, upward force is applied to the setting sleeve 206 and the setting tool body 210 to break the shear pin 220, thereby allowing for removal of the setting sleeve 206 and setting tool body 210. The fishing neck 214 is exposed for grasping by a fishing tool (not shown), and a wire line (not shown) is connected to the fishing neck 214 so that an upward force may be applied to the selection tool 212. The plunger 222 on the lower end of the selection tool 212 is removed from the recess 224 in the lower mandrel 236, so that flow f is allowed from the conduit 284, through the recess and out the port 236. When the upward force is released, the plunger moves back into the recess, thereby closing the port opening 236 off from flow.

Retrieval of the bridge plug 200 is also substantially similar to the retrieval process discussed herein with reference to the bridge plug 100. If the slips 262, 276 should fail to release, sufficient upward force will break the lower shear pin 260, thereby separating the upper and lower mandrel assemblies 202, 204. The upper mandrel assembly 202 may then be pulled upwardly out of the wellbore, while the lower mandrel assembly 204, largely comprising composite materials, may be drilled out with a milling machine.

Thus the present invention represents a significant advancement in the fields of oil and gas drilling and bridge plug technology. A bridge plug is provided that is largely retrievable from a wellbore. However, incorporated into the design is an emergency release that allows at least a portion of the plug to be retrieved if difficulty is encountered in removing the entire tool. In such an event, those components that remain in the wellbore are formed of a composite, drillable material that can be milled to clear the bore. Therefore, removal difficulties encountered with common existing retrievable bridge plugs are addressed. Time and cost for drilling are substantially reduced by making only a portion of the plug drillable, and by drilling only in the event that removal difficulties make retrieval of the entire tool infeasible or impossible.

While the foregoing is directed to embodiments of the present invention, other and further embodiments of the invention may be devised without departing from the basic scope thereof, and the scope thereof is determined by the claims that follow.

What is claimed is:

1. A bridge plug for isolating portions of a downhole casing comprising:

an upper mandrel assembly having a selection tool for controlling fluid flow through the plug; and a lower mandrel assembly coupled to the upper mandrel assembly, wherein the lower mandrel assembly comprises a drillable material.

2. The bridge plug of claim 1, wherein a lower end of the upper mandrel assembly is removeably coupled to an upper end of the lower mandrel assembly.

3. The bridge plug of claim 1, wherein a lower end of the upper mandrel assembly is coupled to an upper end of the lower mandrel assembly using a release mechanism.

4. The bridge plug of claim 3, wherein the release mechanism is a fracturable shear pin.

5. The bridge plug of claim 1, wherein the lower mandrel assembly comprises several components formed of a composite material.

6. The bridge plug of claim 1, wherein the upper mandrel assembly comprises:

a connector formed on the setting sleeve, for connection to a downhole tool; and a setting tool; and an upper mandrel housed within the selection tool.

7. The bridge plug of claim 1, wherein the upper mandrel assembly further comprises an upper mandrel housed within the selection tool.

8. The bridge plug of claim 7, wherein the upper mandrel includes a port in selective communication with a port in the selection tool, wherein actuation of the selection tool places the ports aligns the ports for communication.

9. The bridge plug of claim 8, wherein the selection tool is rotatable relative to the upper mandrel.

10. The bridge plug of claim 1, wherein the selection tool is rotatable relative to the upper mandrel.

* * * * *